United States Patent [19]

Grönborg et al.

[11] 4,382,615

[45] May 10, 1983

[54] ICE SKATE GUARD

[76] Inventors: Jan L. Grönborg, Fullerstavägen 42, S-141 44 Huddinge; Lars E. Persson, Mönstringsvägen 20, S-184 00 Åkersberga, both of Sweden

[21] Appl. No.: 235,111

[22] Filed: Feb. 17, 1981

[51] Int. Cl.[3] ..... A63C 3/12

[52] U.S. Cl. ..... 280/825

[58] Field of Search ..... 280/825, 7.13, 11.18; D21/225; 36/27, 115

[56] References Cited

U.S. PATENT DOCUMENTS

| | | | |
|---|---|---|---|
| 1,658,093 | 2/1928 | Nygaard | 280/825 |
| 1,788,433 | 1/1931 | Johnson | 280/825 |
| 2,108,128 | 2/1938 | Kinney | 280/825 |
| 2,238,084 | 4/1941 | Tuell et al. | 280/825 |

FOREIGN PATENT DOCUMENTS

| | | | |
|---|---|---|---|
| 152976 | 1/1956 | Sweden | 280/825 |
| 200933 | 1/1966 | Sweden | 280/825 |
| 270069 | 11/1950 | Switzerland | 280/825 |

*Primary Examiner*—David M. Mitchell

*Attorney, Agent, or Firm*—Wood, Dalton, Phillips, Mason & Rowe

[57] ABSTRACT

A guard for an ice skate comprises two telescopically movable parts (1, 2) lockable to each other in different positions to adjust the length of the guard and having a channel (5, 6) in which a skate blade (4) is detachably held by a flexible tongue (12) attached to the front end of the front part (1). The tongue permits insertion and removal of the skate blade in and from the channel of the guard against the action of the spring force of the tongue.

3 Claims, 2 Drawing Figures

ICE SKATE GUARD

TECHNICAL FIELD

The present invention relates to an ice skate guard comprising one or more parts having a channel in which an ice skate blade is intended to be detachably held.

BACKGROUND ART

A great number of different skate guards have been developed and used and the designs thereof have been adapted to several different types of skate blades. Conventional guards of one type consist of elastic rubber blocks each having a channel closed at both ends by substantially vertical walls. A skate blade is detachably held in the channel by means of said walls which press against both ends of the blade due to the elasticity of the rubber material. A developed version of this guard consists of a non-elastic material and is lacking the substantially vertical rear wall but is provided with an elastic loop which is moved to surround the skate blade behind the rear column-shaped element connecting the blade to the skate shoe whereupon the guard is moved forwards against the section of the loop force until the substantially vertical front wall on the guard can be moved upwards to hold the tip of the blade.

A similar conventional guard consists of a wood block having a channel for receiving the blade and a yoke in the front end of the block preventing the blade from being moved forwards and upwards. The rear portion of the blade is prevented from being moved upwardly in relation to the block by means of a springing clamp which is attached to the block approximately at the center of one of the long sides thereof and which is rotatable to a clamping position where it partially surrounds the upper enlarged edge of the blade between the two column-shaped elements connecting the blade to the shoe.

The above described guards and other known guards suffer from certain disadvantages. The most common disadvantage is that the elastic material of the guard and/or the clamping means (the loop, for instance) will break after having been used a number of times. Another disadvantage is that one and the same guard cannot be used for skates the blades and/or members connecting blades and shoes having different shapes. Other disadvantages are that each guard can be used for a very limited number of skate sizes only and that the guard is not firmly retained on the skate when it is subjected to heavy stresses.

DISCLOSURE OF INVENTION

The object of the present invention is to provide an ice skate guard which remove the above described disadvantages.

This object is fulfilled by giving the invention the characteristics stated in the patent claims.

The greatest advantages with the invention are that the guard is firmly retained on the skate also when it is subjected to heavy stresses, that the guard easily can be mounted and removed, that the guard is robust and durable and that one and the same guard can be adjusted to be used for a great number of different skate sizes and also can be used for skates having different blade shapes and different shapes of the elements connecting the blades with the skate shoes. Further advantages with the invention should be evident from the following description.

Applicants are the owners of and applicants in design application Ser. No. D-180,697, filed Aug. 25, 1980, now U.S. Pat. No. Des. 265,674, dated Aug. 3, 1982.

BEST MODE FOR CARRYING OUT THE INVENTION

Figure 1:
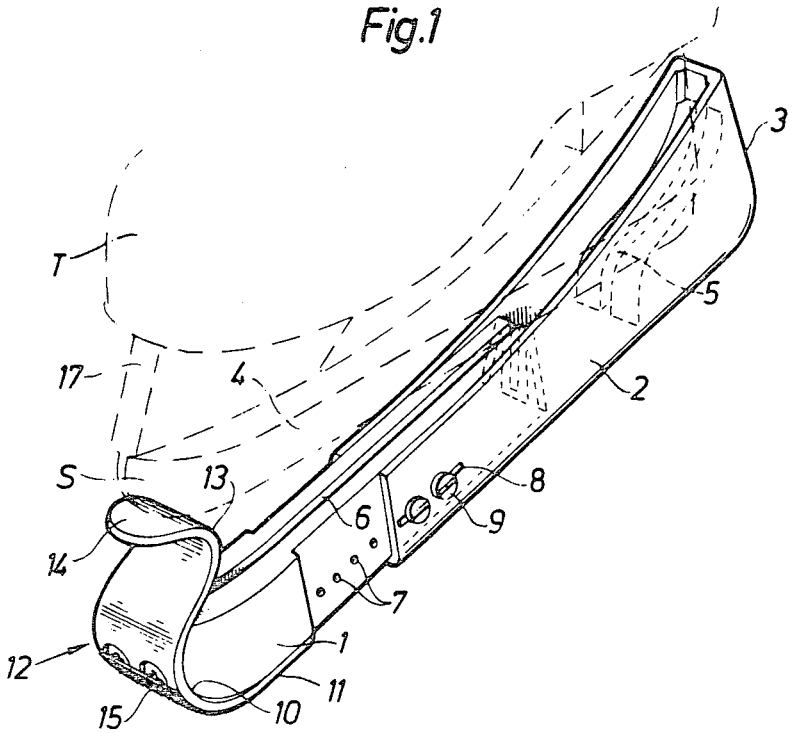
FIG. 1 is a perspective view—seen obliquely from above and from the front—of an ice skate guard in accordance with the invention.
Figure 2:
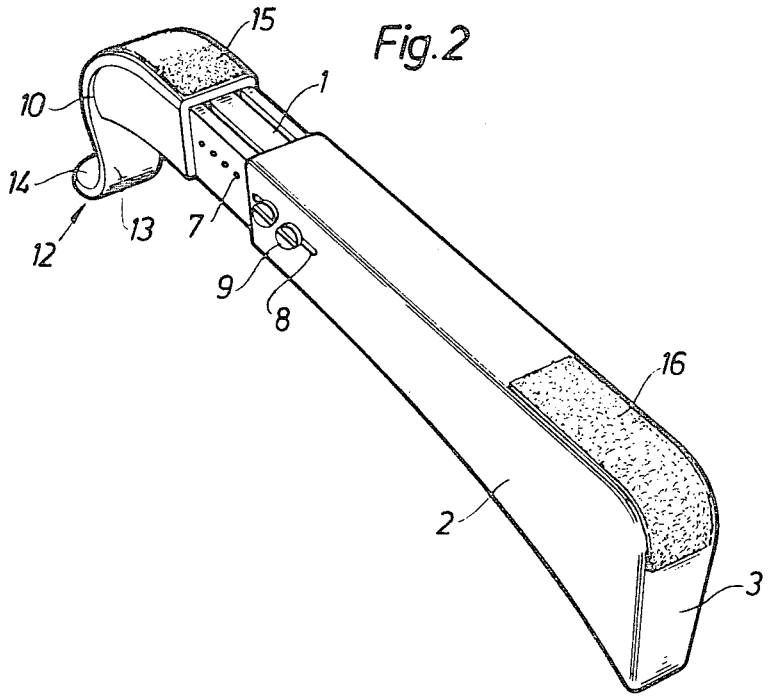
FIG. 2 is a perspective view—seen obliquely from below and from behind—of the skate guard shown in FIG. 1.

As is shown in FIGS. 1 and 2 the ice skate guard in accordance with the invention comprises two main parts, i.e. one front part 1 and one rear part 2, each one manufactured in one piece of hard plastic material. The rear part 2 has a back wall 3 inclining upwardly-forwardly and limiting the backward and upward movement of a skate blade 4 (shown by dash-dotted lines) out from a channel which is formed by an upwardly open relatively short groove 5 in a thickened rear portion of the part 2 and an upwardly open relatively long groove 6 in the part 1. These grooves are aligned. The wall 3 is relatively high to increase safe holding of the guard on the blade 4 and to give the guard sufficient stability.

The part 2 has a paralleltrapezoidal cross section with the short parallel top side open. The rear portion of the part 1 has a corresponding section and fits in the part 2 and is telescopically displaceable within the latter to shorten or lengthen the distance between the wall 3 and the front end of the front part 1 in order to adjust the guard to the desired skate blade length. Due to the trapezoidal section of the parts 1 and 2 the part 1 cannot be removed from the part 2 in any other way than by telescopically pulling the part 1 out from the part 2. The parts 1 and 2 may be locked to each other in anyone of a plurality of desired positions. To this end a number of holes 7 has been formed in both side walls of the part 1 and four slits 8 have been formed in both side walls of part 2. The slits are on the same level as the holes 7. Four screws 9 are insertable in the slits 8 and screwed into opposite holes 7 after the desired guard length has been set. Due to the short distance between adjacent holes 7 and the length of the slits an infinitely variable adjusting possibility is obtained. After screwing, the part 1 is firmly anchored to the part 2.

The front end of the part 1 is provided with an oblique forwardly-upwardly projecting curved surface 10 on which is screwed or in another way attached one leg 11 of a substantially S-formed tongue 12 manufactured from a flexible, wear resistant plastic material. The leg 11 is relatively long and extends along a portion of the underside of the part 1 in order to ensure a firm attachment of the tongue 12. The leg 11 transcends into an intermediate portion 13 bulging in a direction towards the part 2. The portion 13 transcends into a free leg 14 projecting forwardly past a toe-cap T on an ice skate shoe.

Anti-slipping means 15 and 16 are attached to the bottom surface of the leg 11 and to the rear bottom surface on the part 2. These means increase the friction between the guard and the ground when the skater is walking on his skates with the guards on.

When the guard shall be mounted on a skate it is placed on the ground with the grooves directed upwardly whereupon the rear portion of the skate blade 4 is inserted in the groove 5 and is pressed backwards against the wall 3. This position is shown by means of dash-dotted lines in FIG. 1. Then the front curved tip S of the blade is forced downwardly from the position shown in FIG. 1 to engage the tongue 12. The intermediate portion 13 and the leg 14 will be pressed forwardly against the action of the spring force in the plastic material until the tip of the blade 4 has passed the portion 13 and this portion has come into contact with the forward upwardly-backwardly inclining portion of the element 17 which connects the blade 4 with the schematically shown skate shoe. After the tip of the blade has passed the portion 13 the blade 4 is situated in both grooves 5 and 6 and is held in this position by the tongue 12 engaging the element 17.

In the applied position of the guard the bottom surfaces of the element 17 (on each side of the blade 4) are resting on those top surfaces of the parts 1 and 2 having the grooves 6 and 5. This is so because the height of the blade 4, i.e. the vertical distance between the sharp edge of the blade and the bottom surfaces of the element 17, is less than the depth of the grooves 5 and 6. In this manner is prevented that the sharp edge of the blade contacts and wears the bottoms of the grooves.

In order to make the alignment of the blade 4 easier before it is inserted in the groove 6 suitable guiding means (not shown) holding the blade centrally in relation to the tongue 12 may be arranged on the upper surface of the tongue between the portion 13 and the leg 14.

The removal of the guard is performed by pressing a finger or an ice hockey stick, for instance, against the upside of the free leg 14 so that the portion 13 will be forced forwardly whereupon the front tip of the blade 4 and immediately thereafter the whole blade may be lifted upwardly from the guard.

Even though only one embodiment of the invention has been described above and shown on the drawings it should be understood that the invention is not limited to this embodiment but only to that which is stated in the patent claims.

We claim:

1. A guard for the blade of an ice skate comprising: a first elongated part having a channel extending longitudinally thereof to receive the blade partially therein, said part at one end also having a recess opening longitudinally into said channel, said recess having an inwardly-upwardly inclined wall to form a socket for receiving one end of a skate blade, a second elongated part having a channel extending longitudinally thereof to receive the blade partially therein, said parts fitting telescopically one within the other and having a combined length greater than that of the skate blade, means for fixedly securing said parts in various relative positions of adjustment to accommodate blades of different sizes, and a leaf spring element fixedly secured to the free end of said second part and extending laterally in a direction toward a skate whose blade is to be received in said channel, the free end of said leaf spring element being formed to provide an inwardly-upwardly inclined surface to engage and retain the remaining end of a skate blade within the channel and an inwardly-downwardly inclined surface serving as a cam permitting the downward force of the tip of a skate blade temporarily to displace said leaf spring element and subsequently secure the guard releasably to the skate blade.

2. A guard for the blade of an ice skate according to claim 1 in which the means for securing said parts in various positions of adjustment permits adjustment in increments of fixed length and also in increments of varying length.

3. A guard for the blade of an ice skate according to claim 1 in which said leaf spring element is at its free end formed with a manual grasping surface for deflecting the same and releasing the guard from the skate blade.

* * * * *